US005941743A

United States Patent [19]

Kato

[11] Patent Number: 5,941,743

[45] Date of Patent: Aug. 24, 1999

[54] ENGINE CONTROL

[75] Inventor: Masahiko Kato, Hamamatsu, Japan

[73] Assignee: Sanshin Kogyo Kabushiki Kaisha, Hamamatsu, Japan

[21] Appl. No.: 08/877,042

[22] Filed: Jun. 17, 1997

[30] Foreign Application Priority Data

Jun. 17, 1996 [JP] Japan ..... 8-155655

[51] Int. Cl.[6] ..... B63H 20/24

[52] U.S. Cl. ..... 440/1; 440/89

[58] Field of Search ..... 440/1, 89

[56] References Cited

U.S. PATENT DOCUMENTS 5,215,068 6/1993 Kato .
5,261,376 11/1993 Kato et al. .
5,769,053 6/1998 Nonaka ..... 123/417

FOREIGN PATENT DOCUMENTS 407301134 11/1995 Japan .

*Primary Examiner*—Sherman Basinger

*Attorney, Agent, or Firm*—Knobbe, Martens, Olson & Bear LLP

[57] ABSTRACT

An engine control for an internal combustion engine powering a water propulsion device of an outboard motor propelling a watercraft is disclosed. The engine control changes one or more combustion condition parameters of the engine based upon changes in one or more operating conditions of the motor or watercraft which affect the exhaust back pressure of the exhaust in the exhaust system of the engine. The operating conditions may include the motor trim angle, watercraft speed, watercraft posture, transmission position, and engine mount height. The engine control changes a combustion condition parameter such as the air/fuel ratio, spark ignition timing, or fuel injection timing to optimize the engine operating performance based upon the detected operating parameter.

11 Claims, 5 Drawing Sheets

ENGINE CONTROL

FIELD OF THE INVENTION

The present invention relates to an engine control. More particularly, the invention is an engine control which controls at least one engine combustion condition parameter based upon one or more watercraft or motor operating conditions affecting back pressure in an exhaust system of the engine.

BACKGROUND OF THE INVENTION

It has long been a desire to increase the operating performance of internal combustion engines. Electronic engine controls have been created with this goal in mind. For example, it is now common for an engine to include at least one oxygen sensor which provides data to an engine control, the control utilizing the data to optimize the air to fuel ratio by changing the fuel injection timing or volume.

As the cost of fuel increases, it has also become extremely important to improve the operating performance of internal combustion engines in order to reduce their fuel consumption rate. In addition, engines must run efficiently in order that the exhaust produced falls within environmental law parameters.

A variety of operating parameters affect the engine operating condition. For example, the incoming air temperature and pressure is related to the air to fuel ratio. Thus, it is known to measure the air temperature and pressure and then compensate for variations in air density when calculating the desired fuel delivery rate, as with an engine control similar to that described above.

In the field of marine power, one operating parameter which greatly affects engine performance is exhaust back pressure. It is common for the exhaust outlet of the engine to be positioned within a body of water of the watercraft which the engine is powering. The water pressure creates a resistance to the flow of exhaust through the engine, thus causing exhaust back pressure.

The back pressure changes the amount of air and fuel which may enter the combustion chamber from that which would normally enter at a given throttle and injection setting, causing a variance in the air/fuel ratio from a desired ratio. The variation in the air/fuel ratio may result in engine stalling, increased emissions, low power output and other problems.

It is, therefore, an object of the present invention to provide an engine control for controlling the operating condition of an engine dependent upon an operating condition affecting exhaust back pressure within the exhaust system of the engine.

SUMMARY OF THE INVENTION

In accordance with the present invention, there is provided an engine control which adjusts one or more engine operating parameters based upon one or more operating conditions affecting exhaust back pressure.

Preferably, the engine powers a water propulsion device of an outboard motor which propels a watercraft. The engine is of the type having a body defining at least one combustion chamber and includes an intake for providing air to said combustion chamber, a fuel delivery system for providing fuel to said combustion chamber and an exhaust passage leading from said combustion chamber for routing exhaust gasses therefrom.

The engine control comprises means for detecting at least one operating condition of the watercraft or motor which affects exhaust back pressure, and means for adjusting a combustion condition parameter dependent upon the detected operating condition.

The means for detecting preferably comprises a means for sensing an operating condition which affects exhaust system back pressure, such as a speed sensor for detecting the speed of the watercraft, a sensor for detecting the depth of the watercraft in the water, a sensor for detecting the trim angle of the motor and/or the mount height of the engine, and a sensor for detecting a position of the transmission of the motor.

The means for adjusting preferably adjusts the air/fuel ratio, such as by changing the volume of air or fuel supplied to the engine, or changes the spark ignition timing or fuel injection timing to change the combustion characteristics of the engine based upon the detected operating condition indicative of exhaust back pressure.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an engine control. In general, the engine control is adapted to adjust at least one combustion condition parameter of the engine based upon changes in engine exhaust back pressure as affected by one or more external parameters, thereby providing better engine performance.

The engine control of this invention is particularly suited to use with an engine which powers a water propulsion device of an outboard motor propelling a watercraft, since there are several specific operating parameters or conditions of these motors which affect engine exhaust back pressure. It should be understood, however, that the engine control may be utilized with an engine utilized in any of a wide range of other applications.

Figure 1:
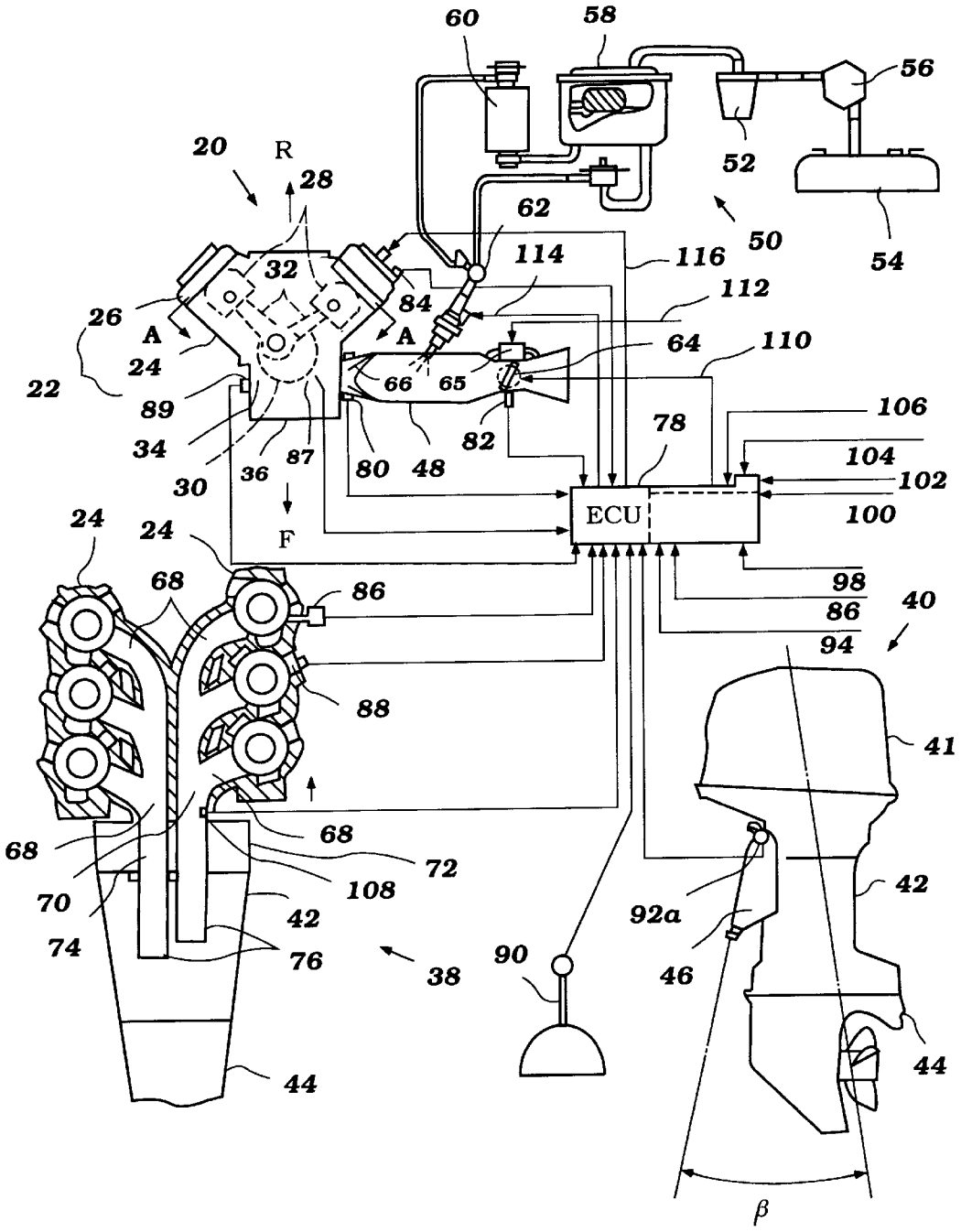
FIG. 1 illustrates in schematic form the engine control of the present invention as it relates to a two-cycle engine powering an outboard motor for use in propelling a watercraft, illustrating a fuel system, the engine in plan end view and in cross-sectional along line A—A of the plan view, and a plan side view of the motor.
Figure 2:
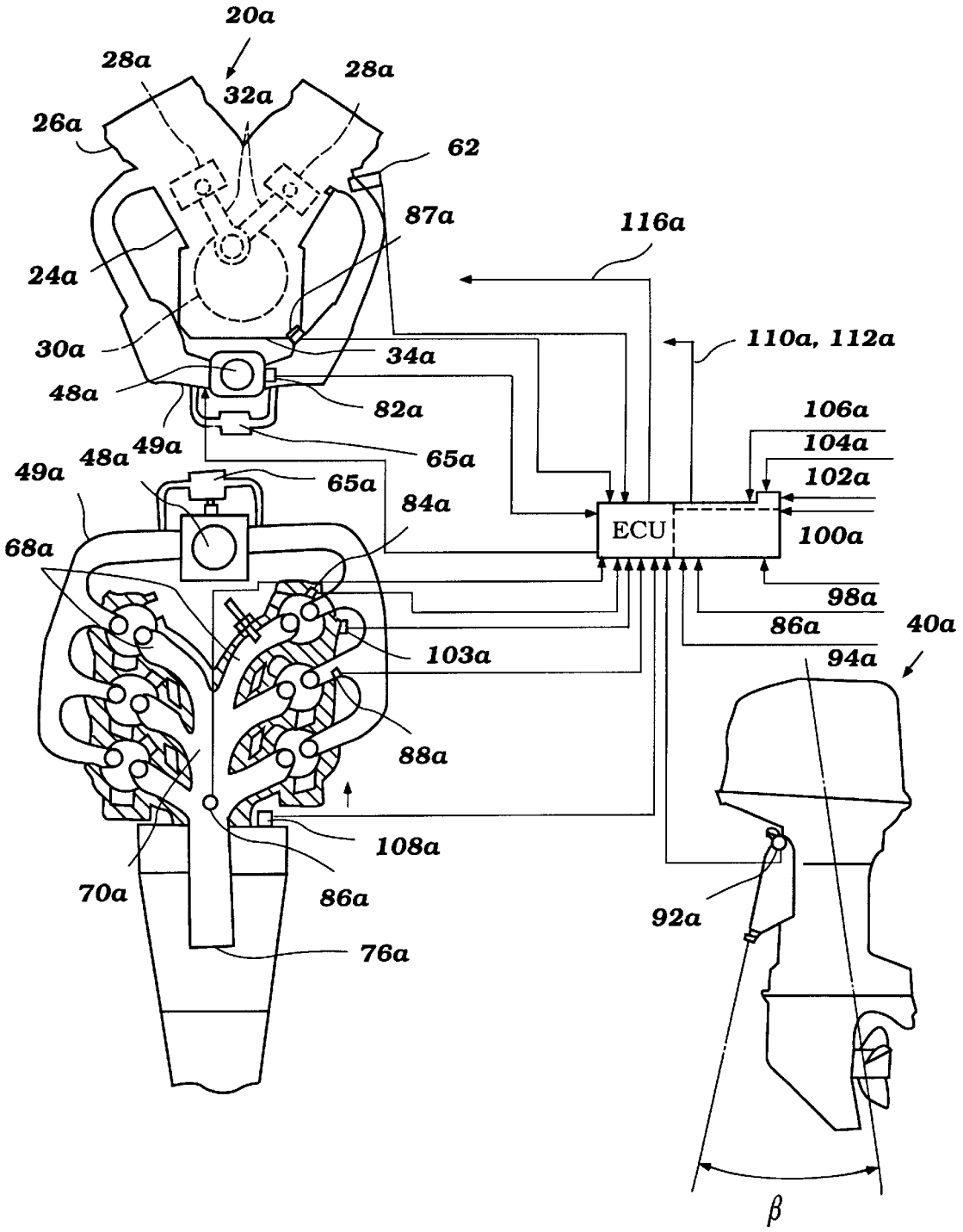
FIG. 2 illustrates in schematic form the engine control of the present invention as it relates to a four-cycle engine powering an outboard motor for use in propelling a watercraft, illustrating a fuel system, the engine in plan end view and in cross-sectional along line A—A of the plan view, and a plan side view of the motor.

The engine control is adapted for use with an internal combustion engine operating on a two-cycle principal (See FIG. 1) or a four-cycle principal (See FIG. 2). An engine 20 operating on a two-cycle principal and controlled by an engine control in accordance with the present invention is illustrated in FIG. 1. In this embodiment, the engine 20 illustrated is of the "V" type. This engine 20 has a body 22 comprising a cylinder block 24 having a pair of cylinder heads 26 connected thereto. The cylinder block and heads 24,26 define a pair of cylinder banks. The cylinder block and head 24,26 comprising each bank defines three cylinders therein.

A piston 28 is movably mounted within each cylinder and cooperates with the cylinder block 24 and its respective head 26 to define a combustion chamber. Each piston 28 is connected to a crankshaft 30 with a connecting rod 32. The crankshaft 30 is mounted for rotation with respect to the cylinder block 24 in a crankcase 34 thereof. The crankcase 34 is positioned opposite the cylinder heads 26 and defined by a cover 36 attached to the cylinder block 24.

It should be understood that the engine 20 may be configured in many other ways than that described above. For example, the engine 20 may have as few as one cylinder per bank, or more than three. In addition, the engine 20 may be arranged in other than "V" fashion.

Preferably, the engine 20 is utilized to power a water propulsion device, such as a propeller, of an outboard motor 40. The motor 38 preferably includes a cowling 41 in which the engine 20 is positioned, and a lower unit positioned below the cowling 41, the lower unit comprising a drive shaft housing 42 and a lower portion 44. The motor 40 is preferably movably positioned to a watercraft (not shown) via a mounting 46. Such mountings are well known in the art.

An intake system is provided for supplying each combustion chamber of the engine 20 with an air and fuel mixture for combustion. In this embodiment, an intake passage 48 leads to the crankcase 34 of the engine 22. The intake passage 48 has one end which is open and through which air is drawn. This air may be drawn from within the cowling 41, or the intake may be arranged to draw air directly from outside the cowling 41.

A fuel system 50 provides fuel into the air passing through the intake passage 48.

The fuel system may have any of a variety of configurations as well known in the art. In the embodiment illustrated, a low pressure pump 52 draws fuel from a supply 54 through a fuel filter 56 and delivers it into a vapor separator 58. A high pressure pump 60 then draws fuel from the vapor separator 58 and delivers it under high pressure though a fuel passage to a fuel injector 62. The fuel injector 62 is arranged to deliver fuel into the air passing through the intake passage 48.

A throttle 64 is provided in the intake passage 48 for controlling the flow rate of air therethrough. The throttle 64 is preferably remotely operable by the operator of the watercraft which is powered by the motor 40.

Preferably, an idle speed control 65, in the form of a throttled bypass passage, is provided for allowing air to bypass the main throttle 64 when it is closed, and yet the engine is runing and requires air. This situation arises, for example, then the engine is idling.

The air and fuel mixture passes through a reed valve 66 and into a crankcase chamber corresponding to one of the cylinders. As is well known, the crankcase 34 is divided into individual chambers, one corresponding to each cylinder.

The air and fuel charge is compressed in the crankcase chamber and then drawn through a passage (not shown) into the combustion chamber of that cylinder, where it is ignited with a spark plug or similar device. Upon ignition, the piston 28 is forced downwardly and effectuates a rotation of the crankshaft 30.

In this arrangement, an intake passage 48 and fuel injector 62 is preferably provided corresponding to each cylinder of the engine 20.

Exhaust gasses from the combustion process are routed from each cylinder through an exhaust port 68. Each exhaust port 68 leads to a common exhaust collection passage 70. This passage 70 may be defined by an exhaust manifold connected to the engine 20 and having branches extending to the passage leading through the engine 20 from each cylinder.

As is common in outboard motor 40 practice, the engine 20 is positioned above an exhaust guide 72. Each common passage 70 extends to a corresponding passage 74 through the exhaust guide 72, and thereon to an exhaust pipe 76 extending into a chamber or muffler 76 in the lower unit of the motor 40. The exhaust is then discharged through a below water hub discharge or an above the water or similar discharge, as is well known in the art.

In operation, the exhaust passage 70 remains open during a time the intake passage leading from the crankcase chamber is open and an air and fuel charge flows into the combustion chamber. Thus, some of the intake charge flows through the cylinder and into the exhaust system through the exhaust passage. In the case where exhaust back pressure varies little, such as when the exhaust is routed into the atmosphere, it is simple to calculate the volume of air which will be drawn into the combustion chamber through the intake, and thus the volume of fuel necessary to provide the desired air and fuel ratio. When the exhaust back pressure varies substantially, however, this is not the case. For example, if the exhaust back pressure rises greatly, the back pressure reduces the amount of the charge which is allowed to flow into the combustion chamber.

In accordance with the present invention, an engine control is provided for controlling one or more aspects of the engine 20. Preferably, this engine control includes an electronic engine control unit or ECU 78. This ECU 78 preferably includes a memory or map of engine control strategies, which, when appropriate engine condition data is supplied thereto, generates instructions for controlling the engine 20.

A variety of data is supplied to the ECU 78 by one or more sensors. As illustrated, a temperature sensor 80 is preferably provided along the intake passage 48 for providing data regarding the temperature of the incoming air. A throttle opening sensor 82 provides data regarding the position of the throttle 64 as controlled by the operator.

An air pressure sensor 84 mounted in one of the cylinders provides data regarding the pressure inside the cylinder of the engine 20. An oxygen sensor 86 is positioned to monitor the oxygen content of the exhaust and provides this data to the ECU 78. A temperature sensor 88 provides data regarding the temperature of the engine 20. A crank angle sensor 87 provides data regarding the position of the crankshaft 30, and thus the pistons 28. A crankcase pressure sensor 89 provides data regarding the pressure of the air and fuel charge within at least one of the crankcase chambers of the engine 20.

A transmission position sensor 90 provides the ECU 78 with data regarding the position of the transmission, such as forward, neutral or reverse. A trim angle sensor 92 provides data regarding the trim or tilt of the motor 40. As illustrated, the sensor 92 provides data regarding the angle β at which the motor 40 is tilted with respect to a mounting bracket thereof (in the embodiment illustrate, a large angle corresponds to a large trim, or that where the motor is rotated in the direction of the surface of the water, while a small angle indicates that the motor is positioned deep in the water). Data such as the engine mount height 94, atmospheric air pressure 96, watercraft speed 98, engine vibration level 100, incoming coolant temperature 102, a transmission neutral signal 104, and watercraft posture 106 (i.e. keel low in the water or high in the water) are preferably also provided to the ECU 78 by sensors as known to those skilled in the art.

Lastly, a back pressure sensor 108 is preferably positioned along at least one of the common or collection exhaust passages 70. This sensor 108 provides the ECU 78 with data regarding the actual pressure of the exhaust within the exhaust system.

In accordance with the present invention, means are provided for adjusting at least one operating parameter of the engine, and most preferably one combustion condition parameter, dependent upon a detected condition which affects the exhaust back pressure. Preferably, this means includes the ECU 78, which receives operating condition data and which then adjusts at least one engine combustion condition parameter based on this detected operating parameter, as described in more detail below.

As illustrated in FIG. 2, the engine control of the present invention is also useful with an engine 20*a* operating on a four-cycle principle. In the description and illustration of this embodinent, like parts have been given like numerals to those utilized in describing and illustrating the first embodiment, and an "a" designator has been added to all reference numerals.

This engine 20*a* generally comprises a cylinder block 24*a* having at least one cylinder head 26*a* connected thereto. The engine 20*a* illustrated is of the "V" type having first and second banks defined by two heads 26*a* connected to the cylinder block 24*a*, each bank defining three cylinders. Again, a piston 28*a* is movably positioned in each cylinder and connected to a crankshaft 30*a* via a connecting rod 32*a*. The crankshaft 30*a* is mounted for rotation with respect to the remainder of the engine 20*a* within a crankcase 34*a* thereof.

An intake system provides air to each combustion chamber. The intake system includes a throttled air inlet 48*a* leading to a passage 49*a* extending to intake passages extending to each cylinder. Again, an idle speed control 65*a* is preferably provided for bypassing the throttle valve when the throttle thereof is closed but air must be delivered to the engine 20*a*, such as when the engine is idling. Exhaust generated in each cylinder is routed through an exhaust port 68*a* and on to a main exhaust passage 70a which extends through the exhaust guide and terminates at an exhaust pipe 76*a* in a muffler or expansion pipe of the motor 40*a*.

Preferably, similar sensors are provided to those described above for providing various condition data to an ECU 78*a*. In this embodiment, an in-engine coolant temperature signal 103*a* is also provided.

Figure 3:
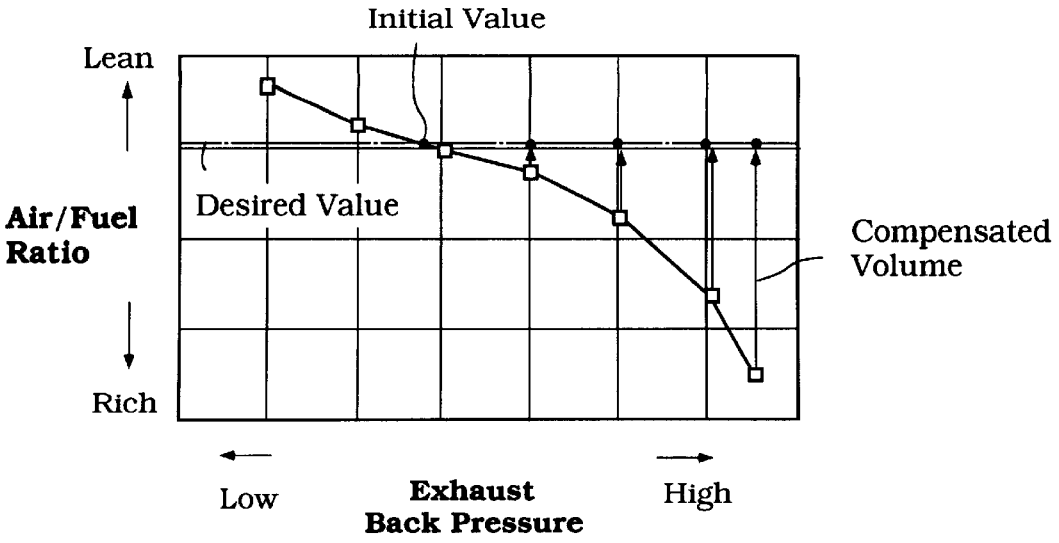
FIG. 3 is a graph illustrating a desired adjusted air/fuel ratio dependent upon exhaust back pressure, as compared to an unadjusted or normal air/fuel ratio.

In a first embodiment of the engine control of the present invention, the ECU 78,78*a* is arranged to adjust the air/fuel ratio of the charge delivered to each combustion chamber dependent upon a back pressure affecting sensed operating parameter. As illustrated in FIG. 3, when a condition is sensed which is likely to cause a high exhaust back pressure, the air/fuel ratio is preferably adjusted so as to be richer than a normal desired value. Preferably, this is accomplished by reducing the volume of air supplied to the engine 22,22*a*. The air volume may be reduced by closing the idle speed control 65,65*a* and/or closing the throttle 64,64*a*.

Likewise, if a condition is sensed which causes a reduction in the exhaust back pressure, then the air/fuel ratio is adjusted so as to be leaner. Preferably, this is accomplished by increasing the volume of air supplied to the engine 22,22*a* This is accomplished by opening the throttle valve 64,64*a* farther (by signal 110), and/or by opening the idle speed control 65,65*a* (by signal 112). If the defected parameter indicates a normal back pressure, then no adjustment need be made.

In the above-described instances, a compensated air volume (either decreased or increased) is utilized to change the air/fuel ratio dependent upon how the operating condition affects the exhaust back pressure.

Figure 4:
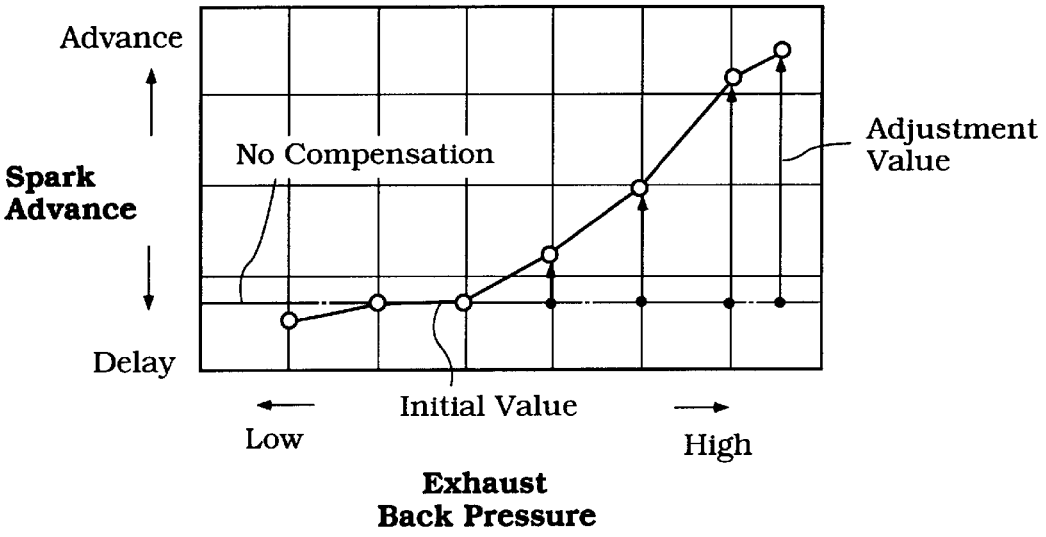
FIG. 4 is a graph illustrating a desired spark advance value dependent upon exhaust back pressure, as compared to an unadjusted or normal value.
Figure 5:
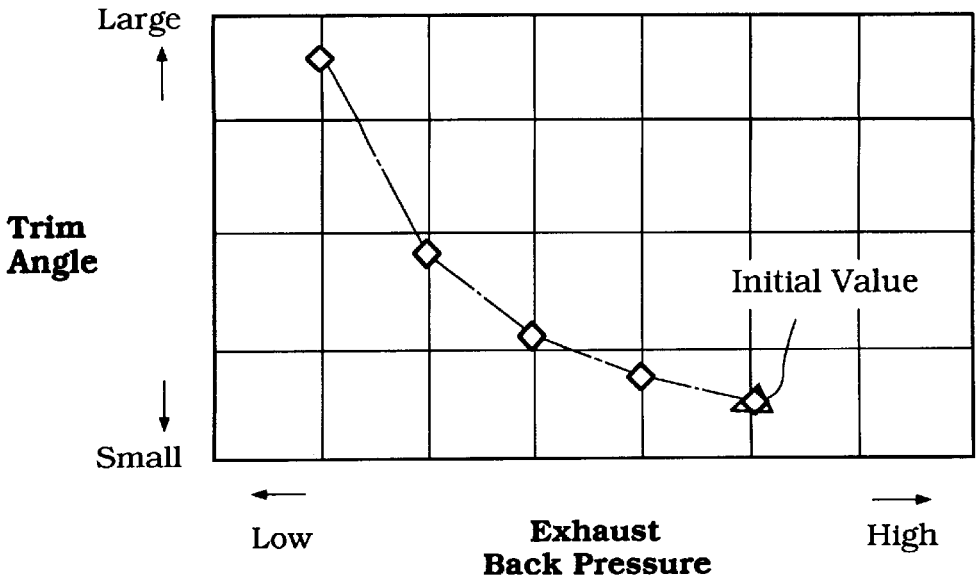
FIG. 5 is a graph illustrating the relationship between exhaust back pressure and the trim angle of the motor.

In a second embodiment, changes in the spark advance or spark firing timing are made in accordance with the exhaust back pressure (such as with ignition signal 116,116*a*). As illustrated in FIG. 4, in the event an operating condition is sensed which affects an increase in exhaust back pressure, the timing of the spark firing is advanced. Thus, the timing of the firing of the spark plug corresponding to each cylinder is caused to be earlier than a normal desired time. Conversely, if the sensed operating condition affects a reduction in exhaust back pressure, then the spark timing is delayed as compared to when the back pressure is high, and may even be lower than a normal desired value when the sensed condition indicates a lower than normal back pressure.

Another alternate means for adjusting the engine combustion condition parameters based on the a sensed exhaust back pressure is as follows. First, the quantity of fuel delivered with each charge to each combustion chamber may be adjusted (such as with signal 114 activating the fuel injector). As in the embodiment illustrated in FIG. 3, the air and fuel volume may be adjusted in this manner. Thus, if the detected operating parameter causes a high exhaust pressure, a great deal of fuel may be supplied to the cylinder to decrease or enrich the air to fuel ratio. Conversely, the volume of fuel delivered may be reduced when the sensed operating parameter causes a lowered exhaust pressure, whereby the air and fuel ratio is lean.

Alternatively, the timing of each fuel injection may be changed with the injection signal 114. In the event an operating condition affecting a high exhaust back pressure is detected, the timing of the start of fuel injection may be advanced. This arrangement is most effective with the four-cycle engine 22*a*, because the fuel is delivered directly into the combustion chamber instead of through a crankcase chamber first.

FIGS. 4–8 illustrate the relationship between various operating conditions or parameters and the exhaust back pressure. As illustrated, if the trim angle is small, the exhaust pressure is high because the underwater exhaust discharge is positioned well below the waterline and the water pressure obstructs the flow of exhaust through the exhaust system. On the other hand, the motor is trimmed, the exhaust back pressure is low since there is little water pressure. Thus, in one arrangement of the present invention, the means for detecting an operating parameter comprises a trim angle sensor 92, and the ECU 78 adjusts the air/fuel ratio, spark or fuel injection timing, or other combustion condition parameter dependent upon the sensed trim angle from the sensor 92.

Figure 6:
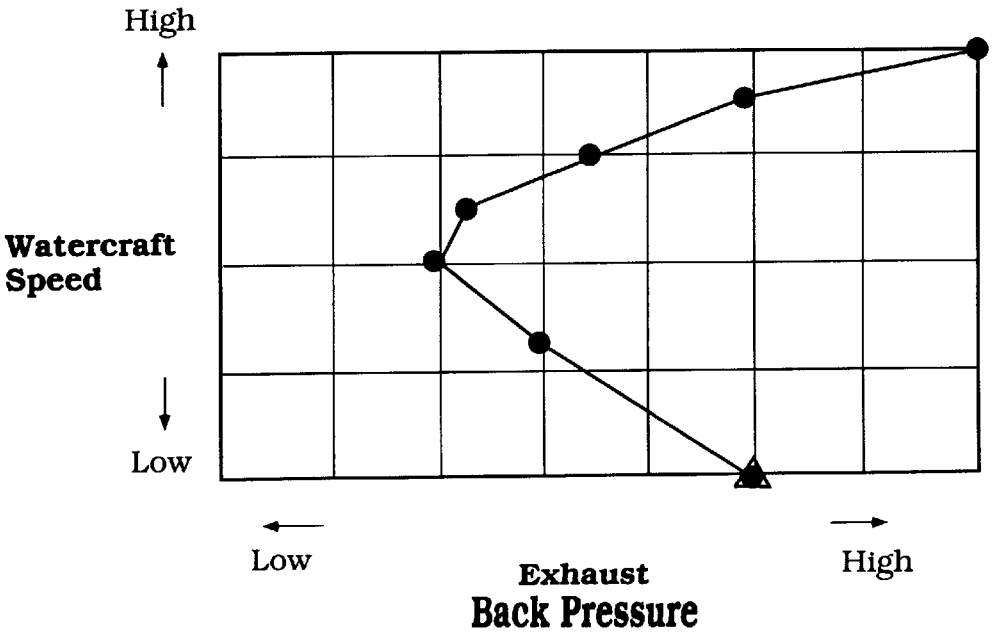
FIG. 6 is a graph illustrating the relationship between exhaust back pressure and the speed of a watercraft powered by the motor.

As illustrated in FIG. 6, when the watercraft speed is low, the exhaust back pressure is relatively high. The exhaust back pressure decreases as the watercraft speed increases (the flow of water drawing exhaust from the exhaust system), and then increases again as the watercraft speed increases further (as a result of cavitation and turbulence). Thus, as another arrangement of the present invention, the means for detecting an operating parameter comprises a speed sensor 98 and the ECU 78 adjusts the air/fuel ratio, spark or fuel injection timing, or other combustion condition parameter dependent upon the sensed watercraft speed from the sensor 98.

Figure 7:
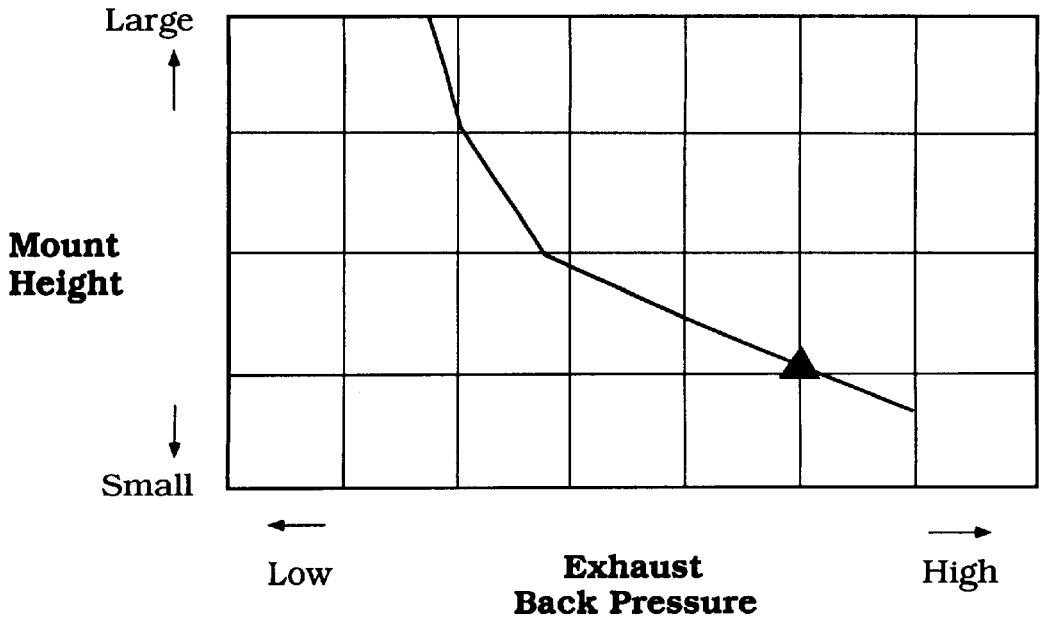
FIG. 7 is a graph illustrating the relationship between exhaust back pressure and a mount height of an engine with respect to the motor.

As illustrated in FIG. 7, the depth at which the exhaust discharge is in the body of water is a factor bearing upon the exhaust back pressure, with the back pressure increasing when the exhaust discharge is positioned deep in the water. Thus, in one embodiment, the means for detecting an operating parameter comprises a sensor monitoring the engine mount height or the position of the engine 22 relative to the water, so as to determine the depth of the exhaust discharge and thus the back pressure. Thus, as another arrangement of the present invention, the ECU 78 adjusts the air/fuel ratio, spark or fuel injection timing, or other combustion condition parameter dependent upon the sensed mount height from the sensor 94 and effectively control the operation of the engine as adjusted for exhaust back pressure.

Figure 8:
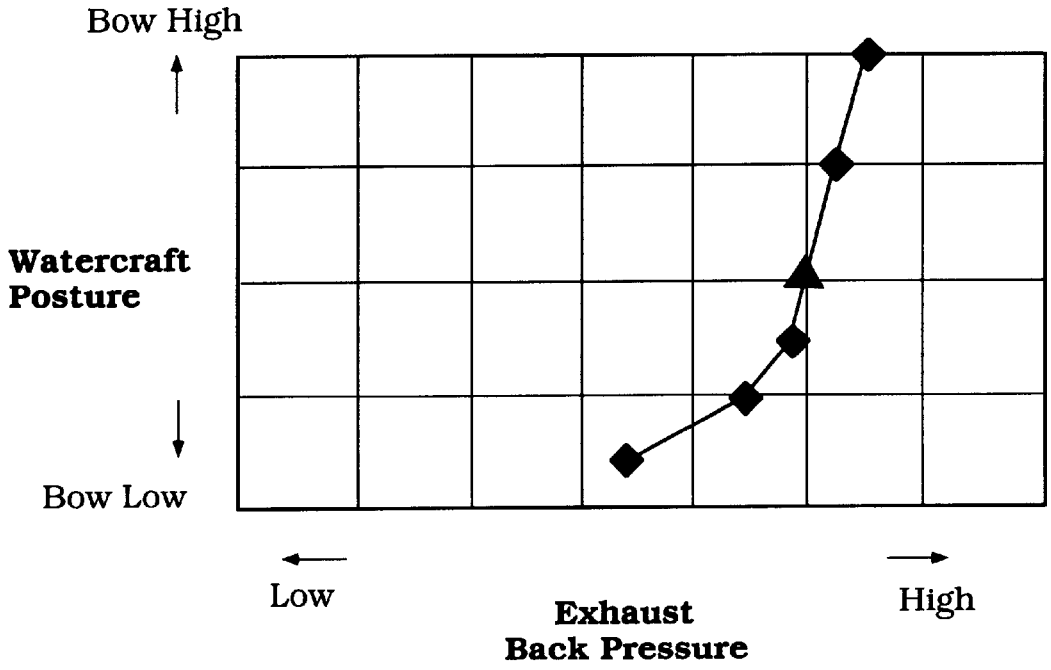
FIG. 8 is a graph illustrating the relationship between exhaust back pressure and the posture of a watercraft powered by the motor.

As illustrated in FIG. 8, when the bow of the watercraft is high, then the stem is low and the exhaust outlet is deep in the water and the exhaust back pressure is high. On the other hand, if the bow is low, the stem is high, and the exhaust outlet is less deep in the water and the exhaust back pressure is lower. Thus, as yet another arrangement of the present invention, the means for detecting an operating parameter of the motor or watercraft comprises the watercraft posture sensor 106, and the ECU 78 adjusts the air/fuel ratio, spark or fuel injection timing, or other combustion parameter dependent upon the sensed depth from the sensor 106.

Another means for detecting an operating condition parameter affecting back pressure is the transmission position sensor 90. As may be appreciated, when the transmission is in a forward gear and the watercraft is moving forward, the exhaust back pressure is lower than the condition where the transmission is in neutral and the watercraft is not moving, or that where the transmission is in reverse and indicates that the watercraft is moving in a direction such that water is being forced into the exhaust discharge. The ECU 78 may monitor this data and change the engine combustion condition parameter based upon the sensed condition of the transmission so as to compensate for changes in exhaust back pressure.

The ECU 78 may also calculate the exhaust back pressure indirectly from the oxygen sensor output 86. In particular, when the exhaust back pressure is high, then the sensor 86 will indicate a higher than anticipated oxygen content. Conversely, a lower than anticipated oxygen content indicates a low back pressure. After indirectly calculating the exhaust back pressure, the ECU 78 may adjust the air/fuel ratio or spark or fuel injection timing to control the operation of the engine as adjusted for exhaust pressure in a manner described above.

Of course, the ECU 78 may also monitor the exhaust back pressure directly from the sensor 108.

While specific examples of changes in engine combustion condition parameters have been described, others are contemplated as within the scope of this invention. For example, when the engine back pressure is indicated as high based upon one of the monitored operating conditions, the air/fuel ratio may be changed so that the mixture is lean instead of rich. When the mixture is enriched, the compensation generally affects an increase in engine speed which aids in forcing the exhaust out and air in, offsetting the exhaust back pressure. It may be desirable, however, to lean the mixture, so that an optimum air and fuel ratio is provided for the specific back pressure.

Of course, the foregoing description is that of preferred embodiments of the invention, and various changes and modifications may be made without departing from the spirit and scope of the invention, as defined by-the appended claims.

What is claimed is:

1. An engine control for an internal combustion engine, said engine powering an outboard motor utilized to propel a watercraft through a body of water, said engine having a body defining at least one combustion chamber and an air intake system for providing air to said combustion chamber, a fuel delivery system for providing fuel to said combustion chamber and an exhaust passage leading from said combustion chamber for routing exhaust gasses therefrom, said engine control effecting changes in an engine combustion condition parameter in response to an operating condition which affects exhaust back pressure without actually measuring actual exhaust pressure to effect such changes, said engine control comprising means for detecting a watercraft or motor operating parameter other than actual exhaust back pressure but which measured parameter is indicate of actual exhaust back pressure in said exhaust passage, and means for adjusting said engine combustion condition parameter dependent upon said operating parameter and not upon measured exhaust back pressure.

2. The engine control in accordance with claim 1, wherein said means for detecting comprises means for sensing the speed of the watercraft.

3. The engine control in accordance with claim 1, wherein said means for detecting comprises means for detecting a trim angle of said motor.

4. The engine control in accordance with claim 1, wherein said means for detecting comprises means for detecting the posture of the watercraft in the body of water.

5. The engine control in accordance with claim 1, wherein said means for detecting comprises means for detecting a mount height of said engine.

6. The engine control in accordance with claim 1, wherein said means for detecting comprises means for detecting a position of a transmission of said motor.

7. The engine control in accordance with claim 1, wherein said means for adjusting a combustion operating parameter adjusts the volume of air delivered to said combustion chamber.

8. An engine control in accordance with claim 1, wherein said engine includes a throttle for controlling the flow of air through said intake and said means for adjusting an engine combustion condition parameter adjusts the position of said throttle.

9. An engine control in accordance with claim 1, wherein said engine includes an idle speed control governing the flow of air to said combustion chamber and said means for adjusting an engine combustion condition parameter controls said idle speed control.

10. An engine control in accordance with claim 1, wherein said means for adjusting an engine combustion condition parameter controls a timing of the firing of a spark ignition element corresponding to said combustion chamber.

11. An engine control in accordance with claim 1, wherein said means for adjusting an engine combustion condition parameter controls a timing of the introduction of fuel to said engine.

* * * * *